US006366643B1

(12) United States Patent
Davis et al.

(10) Patent No.: US 6,366,643 B1
(45) Date of Patent: Apr. 2, 2002

(54) ANTI SCATTER RADIATION GRID FOR A DETECTOR HAVING DISCREET SENSING ELEMENTS

(75) Inventors: James E. Davis, Wilmington, DE (US); Denny L. Y. Lee, West Chester, PA (US)

(73) Assignee: Direct Radiography Corp., Newark, DE (US)

( * ) Notice: Subject to any disclaimer, the term of this patent is extended or adjusted under 35 U.S.C. 154(b) by 0 days.

(21) Appl. No.: 09/679,234

(22) Filed: Oct. 4, 2000

Related U.S. Application Data

(63) Continuation-in-part of application No. 09/181,703, filed on Oct. 29, 1998.

(51) Int. Cl.[7] ..... G21K 1/00
(52) U.S. Cl. ..... 378/154; 378/164; 378/205
(58) Field of Search ..... 378/154, 164, 378/205

(56) References Cited

U.S. PATENT DOCUMENTS

| | | | | |
|---|---|---|---|---|
| 1,164,987 A | | 12/1915 | Bucky | |
| 4,823,370 A | | 4/1989 | Kikuchi | 378/99 |
| 4,875,227 A | | 10/1989 | Rossi et al. | 378/154 |
| 4,951,305 A | | 8/1990 | Moore et al. | 378/147 |
| 5,050,198 A | | 9/1991 | Honda | 378/99 |
| 5,259,016 A | | 11/1993 | Dickerson et al. | 378/186 |
| 5,606,589 A | | 2/1997 | Pellegrino et al. | 378/154 |
| 5,666,395 A | | 9/1997 | Tsukamoto et al. | 378/98.4 |
| 6,252,938 B1 | * | 6/2001 | Tang | 378/154 |

* cited by examiner

*Primary Examiner*—Robert H. Kim
*Assistant Examiner*—Hoon Koo Song
(74) *Attorney, Agent, or Firm*—Ratner & Prestia

(57) ABSTRACT

A shielding grid constructed of a radiation absorbing material for use with an array of discreet, non contiguous radiation sensors to protect such sensors from scattered radiation. The sensors each have a radiation sensitive area with a width and a length. In designing the grid a prototile having a prototile width and a prototile length is developed. The prototile width is equal to the radiation sensitive area width divided by an integer and the prototile length is also equal to the radiation sensitive area length divided by a integer. The prototile contains a motif contained solely within the prototile that forms a pattern when a plurality of prototiles sufficient to cover the array of discreet sensor are arrayed contiguously. The grid is constructed with the radiation absorbing material in this pattern.

10 Claims, 6 Drawing Sheets

ANTI SCATTER RADIATION GRID FOR A DETECTOR HAVING DISCREET SENSING ELEMENTS

CROSS REFERENCE TO RELATED APPLICATIONS

This application is a continuation in part of application Ser. No. 09/181,703 filed Oct. 29, 1998.

BACKGROUND OF THE INVENTION

1. Field of the Invention

This invention relates to a radiation shielding grid for use with a radiation detection panel comprising a plurality of spaced discreet radiation sensing elements, and more particularly to a method for designing such grid to eliminate Moiré patterns and to the resulting grid.

2. Description of Related Art

Direct radiographic imaging using panels comprising a two dimensional array of minute sensors to capture a radiation generated image is well known in the art. The radiation is imagewise modulated as it passes through an object having varying radiation absorption areas. Information representing an image is captured as a charge distribution stored in a plurality of charge storage capacitors in individual sensors arrayed in a two dimensional matrix.

X-ray images are decreased in contrast by X-rays scattered from objects being imaged. Anti-scatter grids have long been used (Gustov Bucky, U.S. Pat. No. 1,164,987 issued 1915) to absorb the scattered X-rays while passing the primary X-rays. Whenever the X-ray detection panel resolution is comparable or higher than the spacing of the grid, an image artifact from the grid may be seen. Bucky also taught moving the anti-scatter grid to eliminate that image artifact by blurring the image of the anti-scatter grid (but not of the object, of course). The anti-scatter grid may be linear or crossed. Bucky furthermore taught a focused anti-scatter grid.

Improvements to the construction of anti-scatter grids have reduced the need to move the grid, thereby simplifying the apparatus and timing between the anti-scatter grid motion and X-ray generator. However, Moiré pattern artifacts can be introduced when films from such apparatus are digitized. Image intensifiers for fluoroscopy can also produce Moiré pattern artifacts. It is known and recommended to align the bars of a linear anti-scatter grid perpendicular to the direction of scan (The Essential Physics of Medical Imaging, Jerrold T Bushberg, J. Anthony Seibert, Edwin M. Leidholdt,Jr., and John M. Boone. c1994 Williams & Wilkins, Baltimore, pg. 162 ff.).

When the X-ray detection panel is composed of a two dimensional array of picture elements or X-ray sensors, as opposed to film or raster scanned screens, the beat between the spatial frequency of the sensitive areas and that of the anti-scatter grid gives rise to an interference pattern having a low spatial frequency, i.e. a Moiré pattern. U.S. Pat. No. 5,666,395 to Tsukamoto et al. teaches Moiré pattern prevention with a static linear grid having a grid pitch that is an integer fraction of the sensitive area pitch.

Two cases are discussed in the aforementioned patent. In the first, the sensors are positioned in the array so that there is no dead space between sensor elements. In this instance, the grid pitch is made equal to an integer fraction of the sensor pitch, the distance between adjacent sensor centers.

In the second case where the sensors are separated by dead spaces, i.e. interstitial spaces which are insensitive to radiation detection, the grid pitch is made to correspond to the sensor pitch and is held in a steady positional relation to the detection panel such that the grid elements are substantially centered over the interstitial spaces.

A problem with the above proposed solutions is that it is difficult to construct a radiation detection panel having no interstitial spaces between adjacent sensor elements. When there are interstitial spaces present, maintaining the anti-scatter grid in a fixed position relative to the radiation sensor array is often impractical.

There is thus still need for a grid that will shield an X-ray radiation sensor array comprised of discreet non contiguous elements from incident scattered radiation, which does not require a fixed positioning relative to the radiation detection panel, or moving during exposure to avoid creating Moiré patterns.

SUMMARY OF THE INVENTION

According to this invention there is provided a scattered radiation shielding grid comprising a radiation absorbing material representing a pattern corresponding to a combined motif of a plurality of tiled prototiles, each prototile comprising a width W(p), a length and a motif solely within the prototile, wherein the prototile width W(p)=W/I where W is a width of a radiation sensitive area of a radiation sensor of a radiation detection panel comprising a plurality of equal size radiation sensors separated by interstitial spaces having a width D, over which said grid is positioned, and where I is an integer.

In accordance with this invention, there is also provided a scattered radiation shielding grid comprising a radiation absorbing material, and a radiation detection panel over which said grid is positioned, the radiation panel comprising a plurality of equal size radiation sensors having a radiation sensitive area width W, separated by radiation insensitive interstitial spaces having a width D, and wherein the grid absorbing material forms a pattern representing a combined motif of a tiled plurality of substantially identical prototiles, each prototile comprising:

(a) a width W(p)=W/I, wherein I is an integer;

(b) a length; and (c) a motif contained solely within the prototile.

Still in accordance with this invention, the detection panel may further comprise a gain correction circuit associated with said detection panel, in which case $W(p)=W/(I\pm0.051)$ and $W(p)\neq W+D$.

When the scattered radiation grid and detection panel according to this invention is used with a radiation source, and the grid is positioned between the panel and the radiation source at a fixed, known distance from said panel, the prototile width W(p) is a projected prototile width on said panel.

Still according to the present invention there is provided a method for designing a pattern for the absorption material to be used to form a scattered radiation shielding grid for a radiation detection panel comprising an array of a plurality of sensors each sensor having a radiation sensitive area, the sensors arrayed so that each radiation sensitive area is separated by each adjacent radiation sensitive area by an interstitial space having a width D, the method comprising:

a) determining a sensor width W corresponding to a width of a radiation sensitive area of the sensor b) creating a prototile having a width W(p)=W/I wherein I is an integer;

c) producing within said prototile a motif and d) tiling a plurality of said prototiles to produce the pattern, said pattern consisting of the combined motif of the tiled prototiles.

Still according to the present invention there is provided a method for manufacturing a scattered radiation shielding grid comprising a pattern of radiation absorbing material for a radiation detection panel comprising an array of a plurality of sensors, each sensor having a radiation sensitive area having a width W and a length, the sensors arrayed so that each radiation sensitive area is separated by each adjacent radiation sensitive area by an interstitial space having a width D, the method comprising:

a) determining a senor width W corresponding to the width of the radiation sensitive area of the sensor b) creating a prototile having a width W(p)=W/I wherein I is an integer;

c) producing within said prototile a motif;

d) tiling a plurality of said prototiles to produce a pattern consisting of the combined motif of the tiled prototiles;

e) forming said radiation absorbing material in said grid in the shape of said combined motif.

Also in accordance with this invention there is provided a method for forming a radiogram with an exposure system comprising radiation source, and a radiation detection panel, wherein the radiation detection panel comprises an array of a plurality of sensors each having a radiation sensitive area having a width W and a length, the sensors arrayed so that each radiation sensitive area is separated by each adjacent radiation sensitive area by an interstitial space having a width D, the method comprising:

positioning between said radiation source and said panel a grid comprising a radiation absorbing material formed in a pattern representing a combined motif of a plurality of substantially identical tiled prototiles, each prototile comprising a width W(p), a length and said motif, said motif contained solely within the prototile, wherein the prototile width W(p) =W/I where I is an integer.

BRIEF DESCRIPTION OF THE DRAWINGS

The invention can be more fully understood from the following description thereof, in connection with the accompanying drawings described as follows.

DETAILED DESCRIPTION OF THE INVENTION

Figure 1:
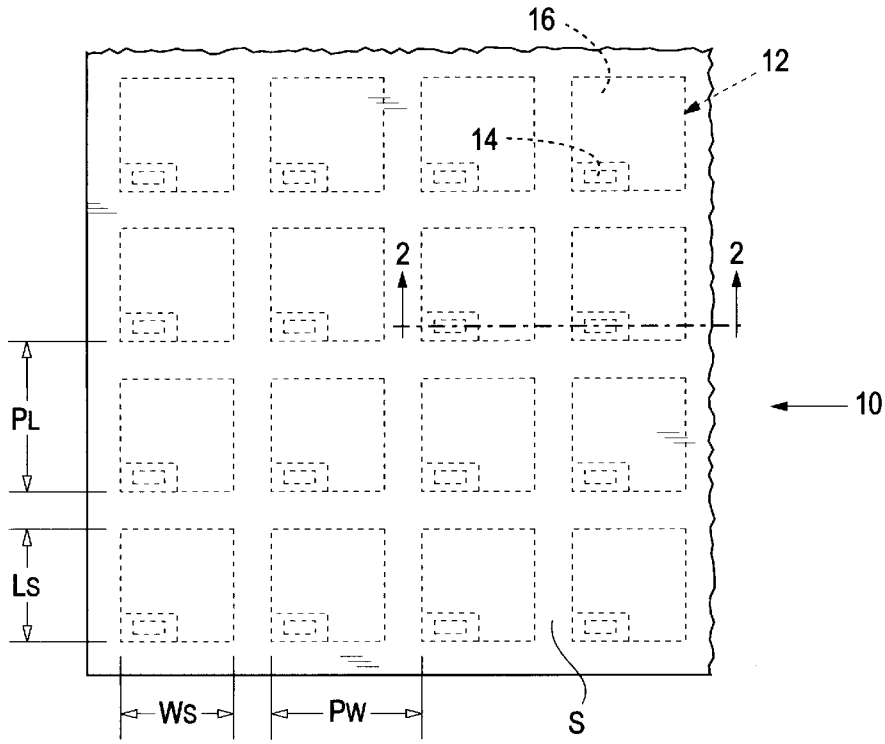
FIG. 1 PRIOR ART
FIG. 1 shows a typical radiation detection panel comprising an array of radiation detection sensors.

Throughout the following detailed description, similar reference characters refer to similar elements in all figures of the drawings. Tiling, in the present context, means the assembly of a plurality of prototiles by arraying the prototiles contiguously side by side to form a large area comprising a plurality of prototiles. As explained in "A series of books in the mathematical sciences" edited by Victor Klee, Copyright 1987, page 20, basic notions, paragraph 1.2 "Tilings with tiles of a few shapes", monohedral tiling is the process of assembling a plurality of same size and shape tiles. Each of these tiles is called a prototile. In the present description, when we refer to tiling we imply monohedral tiling, and when we refer to "prototile", consistent with accepted terminology, we refer to an individual tile of a group of same size and shape tiles. Such prototiles may be virtual, that is exist only as a mathematical expression or may take physical form such as a displayed soft or hard image. When the prototiles contain a design within the prototile, referred to herein as a "motif" the combined motifs of all the tiled prototiles forms a pattern.

Referring now to FIG. 1, there is shown a radiation detection panel 10 useful for radiographic imaging applications.

The panel 10 comprises a plurality of sensors 12 arrayed in a regular pattern. Each sensor comprises a switching transistor 14 and a radiation detection electrode 16 which defines the sensor radiation detection area. Each radiation detection area has a width "$W_S$" and a length "$L_S$", and is separated from an adjacent radiation detection area by an interstitial space "S". The interstitial spaces are substantially incapable of detecting incident radiation. Associated with the sensors there is also a sensor pitch along the sensor length, "$P_L$" and a sensor pitch along the sensor width, "$P_W$".

Figure 2:
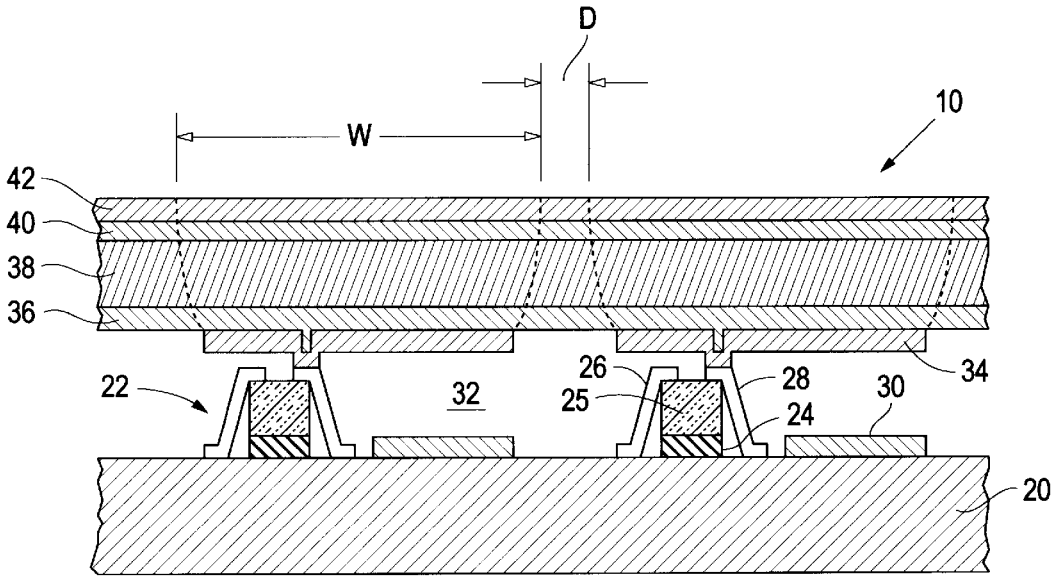
FIG. 2 PRIOR ART
FIG. 2 shows a cross section of the panel of FIG. 1 along line 2—2, showing in schematic elevation one such array sensor.

FIG. 2 shows a schematic section elevation of a portion of the panel 10 viewed along arrows 2—2 in FIG. 1. The sensor used for illustrating this invention is of the type described in U.S. Pat. No. 5,319,206 issued to Lee et al. and assigned to the assignee of this application, and in pending application Ser. No. 08/987,485, Lee et al., filed Dec. 9, 1997, also assigned to the assignee of this application.

Briefly a sensor of this type comprises a dielectric supporting base 20. On this base 20 there is constructed a switching transistor 22, usually an FET built using thin film technology. The FET includes a semiconductor material 25, a gate 24, a source 26 and a drain 28. Adjacent the FET there is built a first electrode 30. A dielectric layer 32 is placed over the FET and the first electrode 30. A collector electrode 34 is next placed over the first electrode 30 and the FET 22. Over the collector electrode there is placed an barrier or insulating layer 36 and over the insulating layer 36 a radiation detection layer 38 which is preferably a layer of amorphous Selenium. A second dielectric layer 40 is deposited over the radiation detection layer, and a top electrode 42 is deposited over the top dielectric layer.

The barrier or insulating layer 36, the radiation detection layer 38, the second dielectric layer 40 and the top electrode layers are continuous layers extending over all the FETs and collector electrodes.

In operation, a static field is applied to the sensors by the application of a DC voltage between the top electrode and the first electrodes. Upon exposure to X-ray radiation, electrons and holes are created in the radiation detection layer which travel under the influence of the static field toward the top electrode and the collector electrodes. Each collector electrode collects charges from area directly above it, as well as some fringe charges outside the direct electrode area. There is thus an effective radiation sensitive area "W" associated with this type of sensor which is somewhat larger that the physical area of the collector electrode. The sensitive areas are separated by a dead space D. In the case where the effective sensitive area is equal to the electrode area, D becomes the interstitial S space.

In an embodiment where the radiation detection layer is columnized, that is where the radiation detection layer extends upward from the collector electrode in an isolated column, the radiation sensitive area will be the same as the physical area of the collector electrode. This is particularly true in the type of sensor which employs a photodiode together with a radiation conversion phosphor layer. In such cases the phosphor layer is usually structured as discreet columns rising above the photodiode.

In describing this invention we will use the term "radiation sensitive area" to designate the actual area which is radiation sensitive, whether it is the same as the physical area of the sensor or not. We will use the term "opaque" to designate radiation absorption material. In addition, because in practical use an anti-scatter grid is (a) three dimensional and (b) is occasionally placed spaced from the surface of the radiation detection layer, the terms prototile width and prototile length refer to the width and length of a prototile such that its projected image on the sensitive surface satisfies the required relationships between prototile dimensions and sensitive surface dimensions, when the prototile is in the grid plane. For design purposes, this can be any plane through the grid, parallel to the width and length of the grid. Preferably, this plane is the plane closest to the sensitive surface. Finally, while the grid is usually described as having a height perpendicular to its width and length, it is to be understood that this height can also be inclined with respect to the perpendicular to produce a grid having opaque elements aligned with the incident radiation path which may be a path that diverges radially from the radiation source. This type of grid element orientation is also well known in the art and grids having such inclined wall are described in the aforementioned U.S. Pat. No. 4,951,305 Moore et al. (See particularly Moore, FIG. 8.) Grids having such oriented elements are still to considered as being included when there is reference to a grid height.

In practice, particularly where the grid is placed in contact with, or close to the sensitive surface, the projected and actual dimensions will be substantially the same, in which case the actual dimensions will be convenient to use.

Figure 3A:
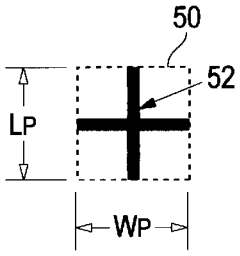
FIG. 3A shows the prototile used in designing the grid of FIG. 3.
Figure 3:
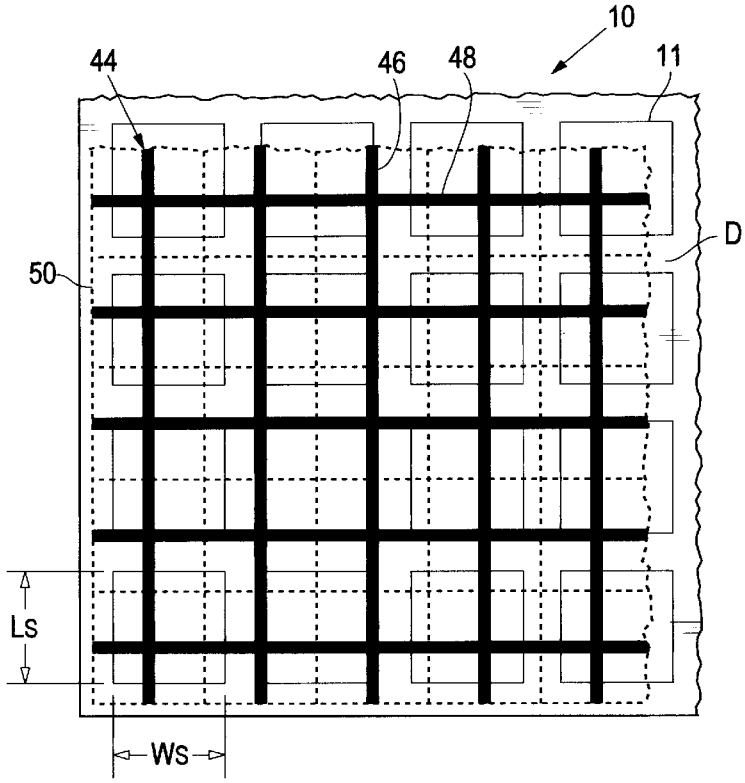
FIG. 3 shows an anti-scatter grid placed over a detection panel, the grid designed using a prototile according to one embodiment of this invention.

FIG. 3 shows a radiation detection panel of the type described above with a scattered radiation shielding grid 44 placed over the panel. As shown in the figure, the grid comprises a pattern of a plurality of opaque strips 46 and 48 aligned along the width and length of the panel.

This type of anti-scatter grid, is a common type of anti-scatter grid available, and may be manufactured easily. See for instance U.S. Pat. No. 5,606,589 issued to Pellegrino et al. which discloses such a cross grid and a method for its manufacture and use in medical radiography.

However, use of this type of grid with a radiation detection panel of the type disclosed above is prone to the production of Moiré patterns, unless, as taught by Tsukamoto et al., U.S. Pat. No. 5,666,395 the grid is fixed in relationship to the underlying array of radiation sensors, the grid pitch is the same as the array pitch, and the grid bars are aligned with the centerlines of the interstitial spaces.

The present invention employs a grid having a pattern of absorbing material that does not produce Moiré patterns without requiring the exact placement of the grids of the prior art. As clearly shown in FIG. 3, the absorbing material pattern of grid 44 is not aligned with the interstitial or dead spaces of the underlying array of sensitive areas 11. Unlike the Tsukamoto grid, grid 44 may be placed anywhere and still function effectively. Further more the grid may be moved during the radiation exposure.

Grid 44 has been designed in accordance with this invention by tiling a plurality of prototiles 50 shown in dotted lines in FIG. 3 to generate the pattern for the absorbing material.

As better shown in FIG. 3A, the prototile 50 has a width Wp and a length Lp. The width of the prototile Wp equals the width Ws of the radiation sensitive area 11 of the sensor of the panel divided by an integer A. Thus Wp=Ws/A. In most instances A=1.

The same is applicable to the length Lp of the prototile relative to the length Ls of the sensitive area; again Lp=Ls/B, where B is an integer, and again, preferably B=1.

Each of the prototiles includes a motif 52 which will be used to design the opaque portion of the grid. In FIG. 3A this motif is a cross. The motif is selected such that when the prototiles are tiled, the motifs of the plurality of the tiled prototiles combined form the pattern shown in FIG. 3. This is the pattern for the opaque material in the grid.

The grid pattern need not be a plurality of strips intersecting at 90° angles. A number of different grid designs can be produced using the technology disclosed in U.S. Pat. No. 5,259,016 issued to Dickerson et al. The use photographic techniques to produce radiation absorption grids having shapes other than straight lines is shown in that reference and can be used to produce grids designed using the present invention wherein the opaque grid strips are other than straight lines. The aforementioned U.S. Pat. No. 4,951,305 issued to Moore et al. also teaches methods for producing complex grid shapes.

Figure 4A:
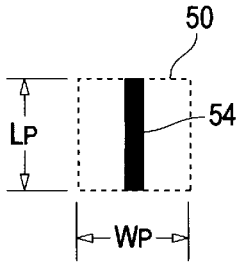
FIG. 4A shows the prototile used in designing the grid of FIG. 4.
Figure 4:
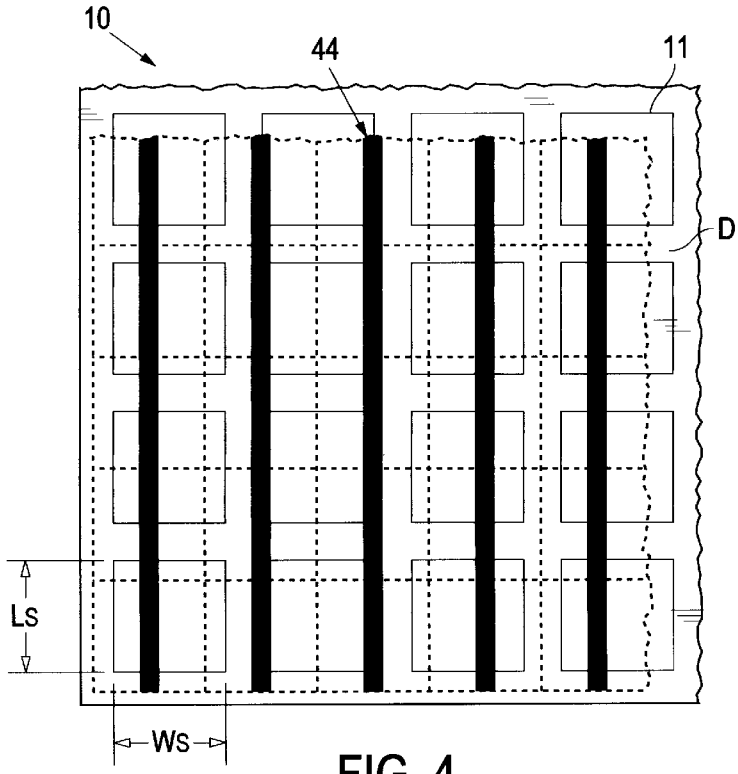
FIG. 4 shows another grid designed from the assembly of a plurality of prototypes according to this invention.

FIG. 4 shows a grid 44 generated from a prototile 50 having a width Wp and a length Lp and motif 54 shown as a single bar. The radiation sensitive area 11 has a width Ws, a length Ls. The interstitial space S separates the sensitive areas. The resultant anti-scatter grid 44 is in many respects like the common linear anti-scatter grid in common use today, except the distance between the opaque regions is equal to the sensitive area width of the sensor. For a sensitive area having a width of 135 microns the grid 44 would preferably have 188.1 bars per inch (7.407 per mm).

Although the above discussion has been limited to the grid design in the x-y plane, it is understood that the grid has a third dimension along the z axis, or in other words the grid walls have a height.

The wall height ranges from about 2 to 16 times the thickness of the wall. A preferred height ratio is about 6 to 12. The ratio of wall thickness to the prototype width ranges from about 1/10 to 1/2 with a preferred ratio of about 1/6.

Because the radiation impinges on the panel at different angles rather than perpendicular, i.e. along the z axis, the projection of the grid on the panel will be both magnified and distorted depending on the distance of the grid from the radiation sensitive surface, and to some extent depending on the distance and nature of the radiation source.

A collimated radiation source, for instance, will produce no magnification or distortion effect, while a point source will produce both. These effects are well understood in the art and proper compensation to the grid design will be made, by designing a grid such that the projected prototile on the panel will satisfy the above developed criteria. These effects are minimized by placing the grid in close proximity and preferably intimate contact with the sensitive area, and by minimizing the grid wall height.

In the example given above, if the grid 44 is spaced 1 cm away from the sensitive area of the detection panel and the X-ray generator is 1 meter away, the preferred grid 44 would have 190.0 pairs per inch (7.480 per mm) to correct for the geometric magnification, instead of 188.1 bars per inch (7.407 per mm).

Inspection of FIG. 4 shows that exactly one bar 54 of opaque material is projected onto each radiation sensitive area 11. This is obvious for most translations of the bar. It is also true when two bars partially project onto the sensitive area 11, the part of one bar not projecting onto the sensitive area is exactly equal to that projected by the other bar. Because the amount of X-rays passing to any sensitive area is constant no Moiré pattern interference will be introduced, either static or in translation along any line. This anti-scatter grid can be oriented horizontally in which case the tiling pitch will be made equal to the effective sensitive area length rather than the effective sensitive area width.

Figure 5A:
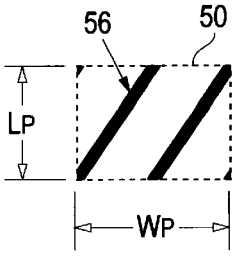
FIG. 5A shows the prototile used in designing the grid of FIG. 5.
Figure 5:
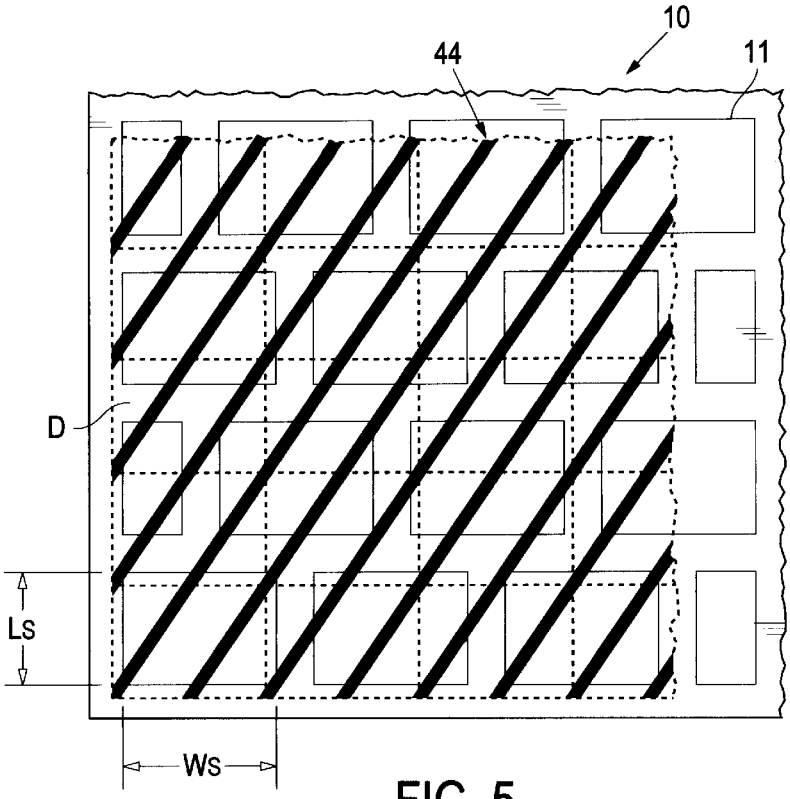
FIG. 5 shows a grid designed according to yet another embodiment of this invention.

It is a remarkable feature of the present invention that the radiation sensitive areas 11 of the radiation detection panel need not be in a regular array. As shown in FIG. 5, they may be unevenly arrayed and still enjoy the benefits of this invention. However, the radiation sensitive areas must be identical in shape, size and orientation. FIG. 5 and its associated prototile shown in FIG. 5A also illustrate a grid design and prototile motif 56 for the case where the radiation sensitive area width is different from the sensitive area length. As shown the resulting prototile width and length are also different.

While there is great latitude in selecting the motif for the opaque regions in a prototile, a preferred X-ray transparent region will have no edges collinear with either edge of the sensitive area as shown in the grid of FIG. 5. Preferred X-ray opaque motifs may include circles, ovals, rectangles, and other shapes. The intention is to minimize the amount of the opaque motif of the prototile projected on the sensitive area boundary as the motif shifts its relative position with respect to the sensitive area along the panel surface. Because the resulting opaque pattern following tiling has a pitch that is less than the sensor pitch, invariably the opaque pattern will fall on the line that divides the sensitive area from the interstitial area (See FIG. 4). Again, because of the grid pitch, as the opaque area exits at one end of the sensitive area, another opaque area enters from the opposite end. If the thickness of the opaque areas were reproduced with absolute accuracy so that it is always the same, the opaque area covering the sensitive area would always be constant. However, because in practice it is difficult to create opaque areas with absolutely the same thickness, it is preferred to select a motif which creates a pattern without opaque areas parallel to the boundary between the interstitial spaces and the sensitive area.

Figure 6A:
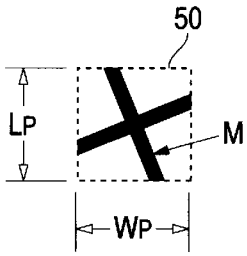
FIG. 6A shows the prototile used in designing the grid of FIG. 6.
Figure 6:
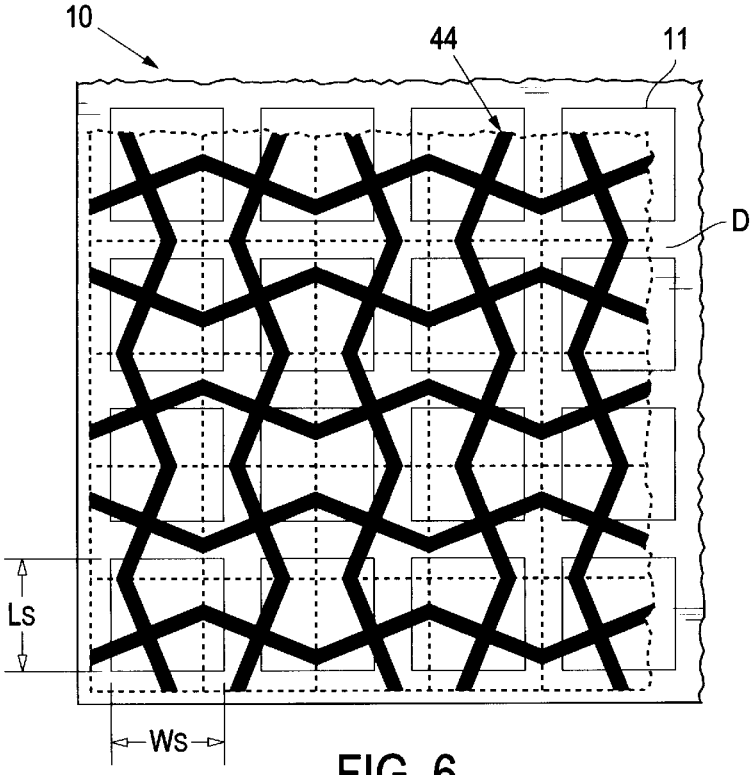
FIG. 6 shows a grid designed according to yet another embodiment of this invention.
Figure 7A:
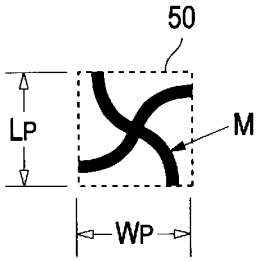
FIG. 7A shows the prototile used in designing the grid of FIG. 7.
Figure 7:
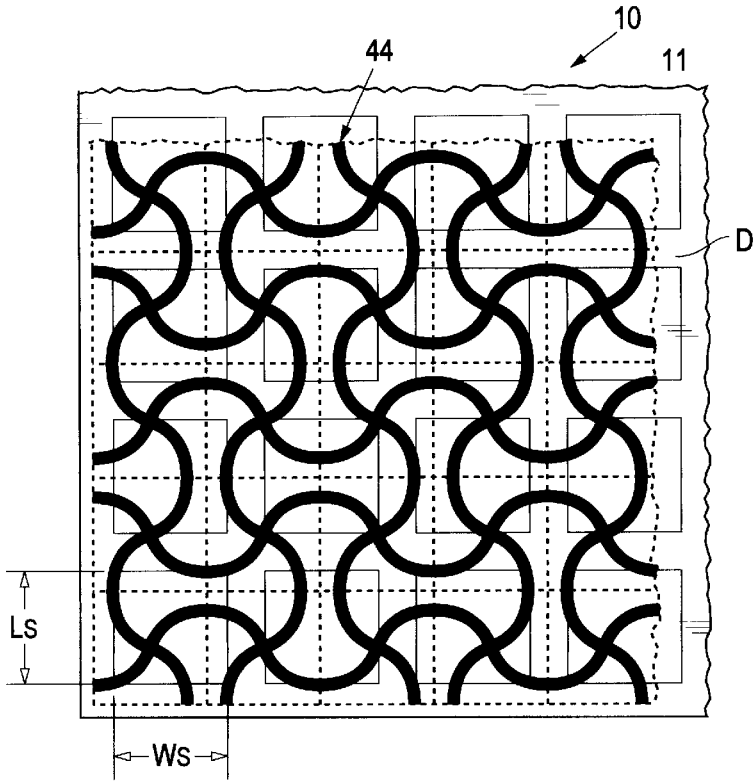
FIG. 7 shows a grid designed according to yet another embodiment of this invention.

FIGS. 6A and 7A show alternate motifs M resulting in grid 44 structures shown in FIGS. 6 and 7 which do not include opaque areas parallel to the aforementioned boundary.

Figure 8A:
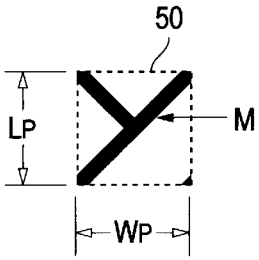
FIG. 8A shows the prototile used in designing the grid of FIG. 8.
Figure 8:
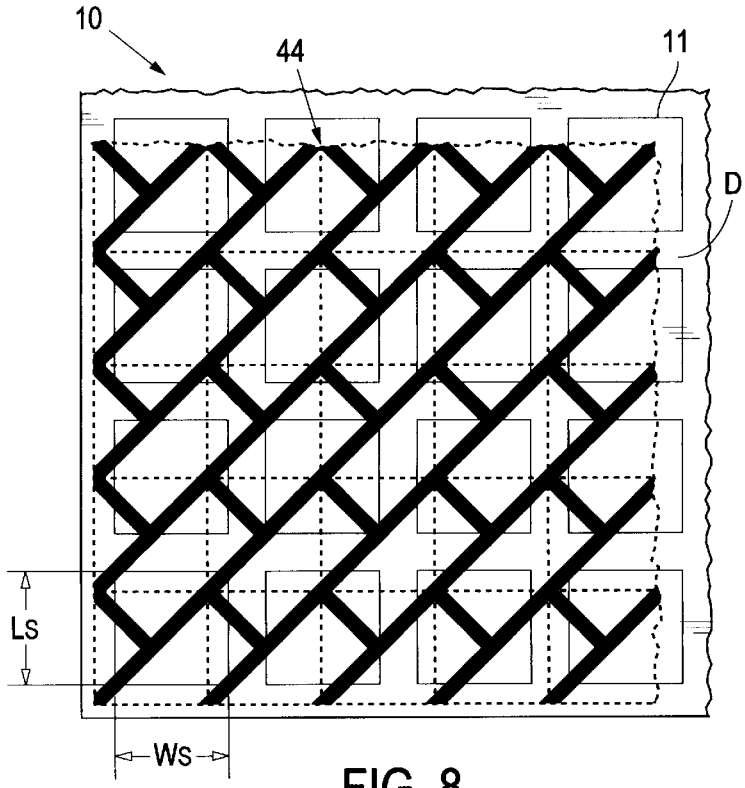
FIG. 8 shows a grid designed according to yet another embodiment of this invention.
Figure 9A:
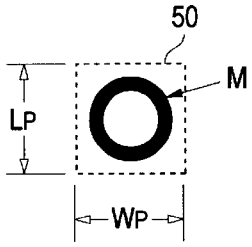
FIG. 9A shows the prototile used in designing the grid of FIG. 9.
Figure 9:
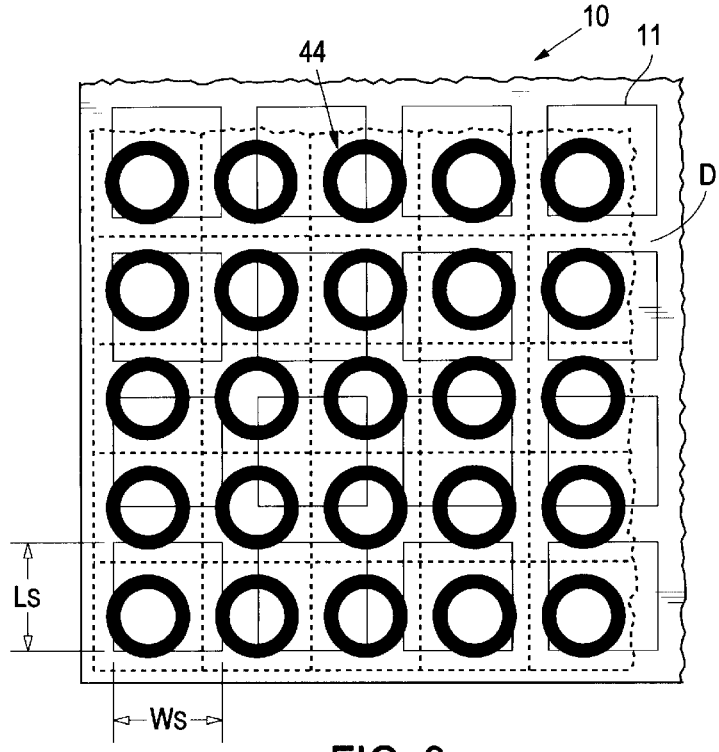
FIG. 9 shows a grid designed according to yet another embodiment of this invention.
Figure 10A:
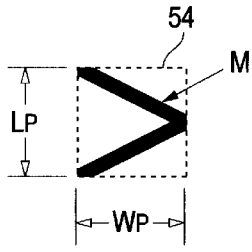
FIG. 10A shows the prototile used in designing the grid of FIG. 10.
Figure 10:
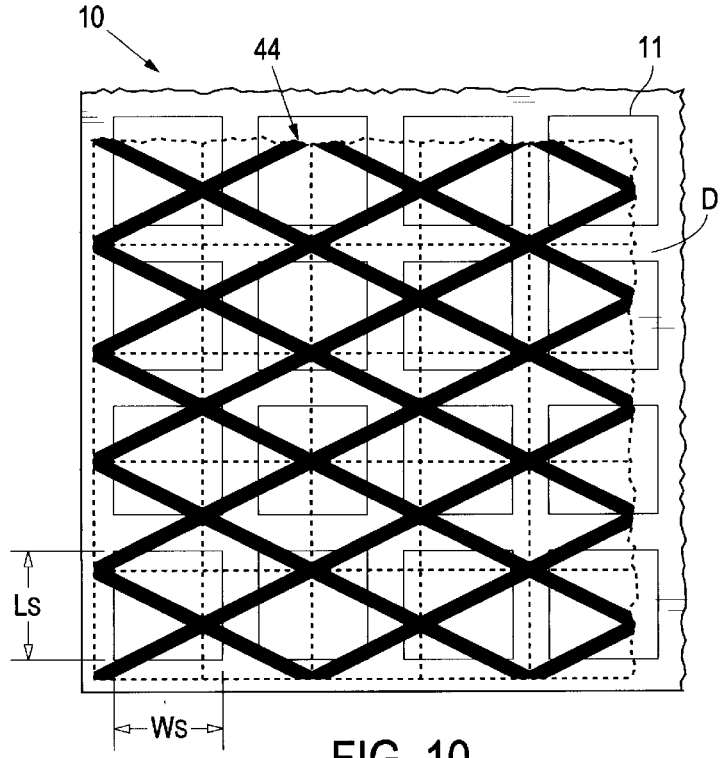
FIG. 10 shows a grid designed according to yet another embodiment of this invention.

FIGS. 8, 9, and 10 all show different grids 44 designed according to the present invention. The prototiles 50 and motifs M used in these cases are shown in FIGS. 8A, 9A, and 10A respectively. In all cases the prototile 50 has a width Wp and a length Lp as defined hereinabove.

In all instances, the resulting grid of radiation absorbing pattern is such that the radiation opaque area of the grid always covers the same amount of radiation sensitive area in each sensor, regardless of the position of the grid.

In summary, a grid will be constructed as follows. First, the effective radiation detection area of the panel sensors is determined to identify the radiation sensitive area and the prototile size is then determined according to the relationships given above. Next, a desired motif is created in the prototile. The prototile is then duplicated and a plurality of prototiles assembled to create the pattern of the grid which results from the combined motifs of the prototiles. Mirror images of the prototile may be used with the original prototile to create a pattern. This pattern is then used for the radiation absorption material which forms the anti-scatter grid. This material may be lead. The grid may be constructed according to the teachings of the aforementioned U.S. patents to Dickerson et al., Pellegrino et al. or Moore et al. If the grid is not to be in contact with the sensors and the radiation source is a point source, the prototile design takes into account the projection of the grid onto the sensitive area.

As may be surmised by the above discussion, it is very difficult to obtain grids with the exact requisite absorbing material spacing and thickness completely free from manufacturing imperfections. Further more, thermal expansion may alter somewhat the grid element spacing, and a shift during installation may change the originally calculated distance between the grid elements and the detection panel so that the relationship $W(p)=W/I$ no longer holds absolutely true. Surprisingly, it has been observed that some deviation of the theoretically optimum grid pattern for a particular detection panel and grid positioning is acceptable when the detection panel includes, as is almost always the case, an associated gain control circuit.

Gain control circuits are used to compensate for different output levels of different individual sensors in an array of such sensors by correcting the individual output of each sensor such that when a detection panel is illuminated by uniform intensity radiation, the output of each sensor becomes the same. In a typical digital gain correction system, this involves a calibration step whereby prior to using a detection panel in an image detection system, the panel is exposed to uniform radiation at a predetermined level of intensity. Each of the individual sensors output is recorded and for each individual sensor there is generated and stored a correction factor usually in a Look-Up-Table (LUT). When an image is obtained the raw output of each sensor is corrected by the corresponding correction factor from the LUT.

According to this invention, if the calibration step is undertaken with the grid in place, whereby instead of a substantially uniform illumination level the grid image is projected on the panel, variations in the grid absorbing material pattern of as much as + or −5% from the calculated dimensions are compensated for by the gain correction system. Thus a manufactured grid whose pattern corresponds to a prototile width $W(p)=W/(I\pm0.05I)$ and $W(p)$ different ($\neq$) from $W+D$ still results in a grid that presents no objectionable Moiré patterns.

Figure 11:
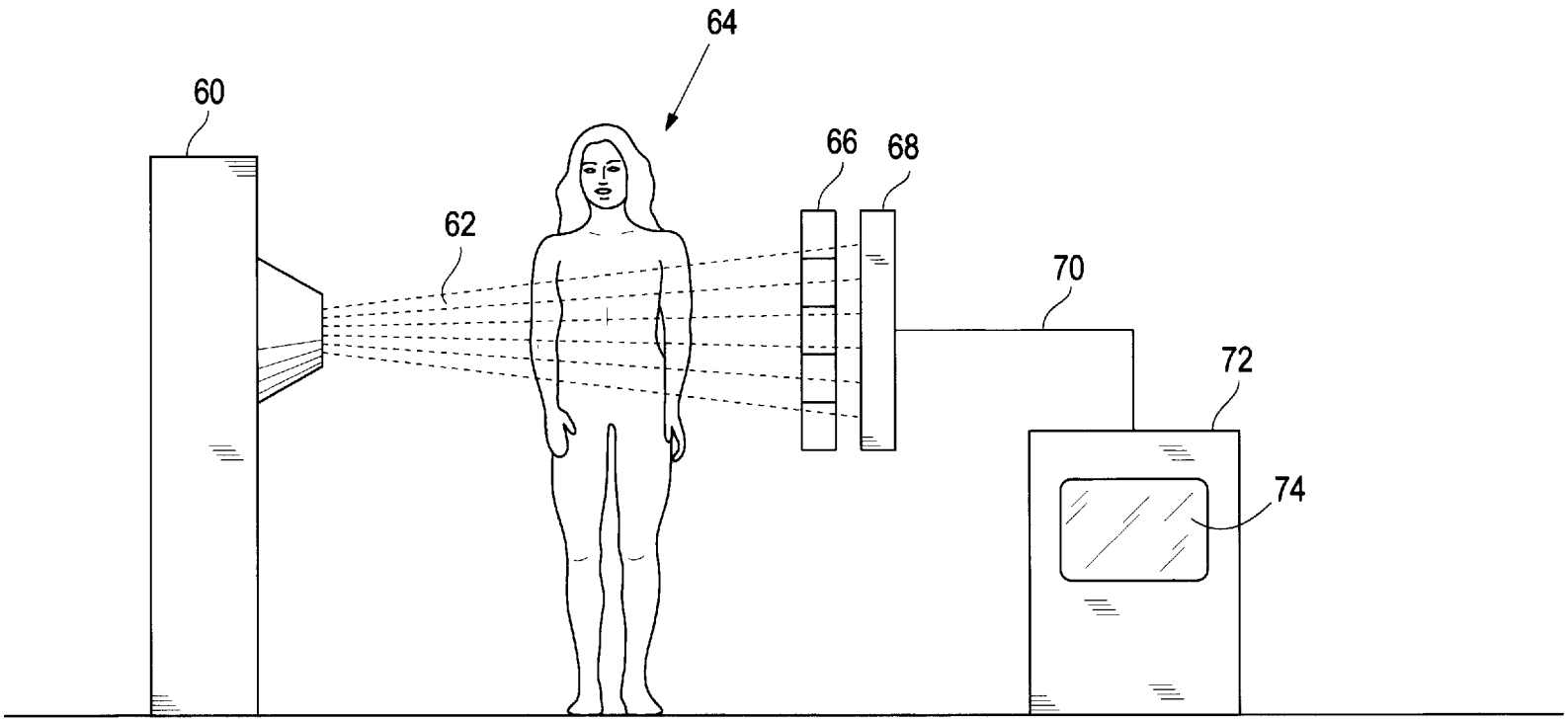
FIG. 11 shows in schematic representation a system for obtaining a radiogram of a target, comprising a radiation source, a radiation detection panel, and a grid placed at a fixed distance between the source and the radiation detection panel.

FIG. 11 illustrates the use of this grid in a system to obtain a radiogram. The system includes a radiation source 60 which is typically an X-ray source emitting a beam of radiation 62. A target or patient 64 is placed in the beam path. On the other side of the patient there is placed a combination of a grid 66 and detection panel 68. The grid is a grid created in accordance with the present invention and has a pattern of absorbing material, such as, for instance, shown in FIG. 3 discussed earlier. Behind the grid 66 at a fixed distance therefrom is positioned a radiation detection panel 68 such as the panel described earlier in conjunction with FIGS. 1 and 2. The panel is connected over wire 70 to a control console 72 which may include a display screen 74 and/or a hard copy output device (not shown) for producing a hard copy of the radiogram. Typically the control console will also include a plurality of image processing circuits, all of which are well known in the art. Preferably, a gain control circuit is included, either as a part of the detection panel itself or as part of the control console.

Preferably, the grid was originally designed such that $W(p)=W/I$. However even if due to manufacturing imperfections, thermal change, actual spacing between the installed grid and detection panel or whatever other reason such relationship is not satisfied exactly, as long as the actual grid pattern satisfies the relationship $W(p)=W/(I\pm0.05I)$ discussed above, such grid is acceptable.

In obtaining the radiogram, first the system is calibrated by obtaining a blank exposure of the detection panel, that is one without the target present, and using the gain control circuit to generate a flat field output image, i.e. one that has a uniform density throughout the image area. The target is then placed in position and exposed to radiation. The radiation becomes imagewise modulated as it traverses the target and impinges on the detection panel after transiting the grid. The resulting image has been found substantially free of Moiré interference patterns. The same result was obtained whether the grid was stationary during exposure or whether the grid is mounted on a moving support that moves the grid during exposure in a plane substantially parallel to the plane of the detection panel.

Those having the benefit of the above disclosure which teaches a grid for limiting scattered radiation from impinging on a radiation detection panel having an array of sensitive areas separated by non radiation sensitive interstitial spaces by designing a grid of radiation opaque areas such that regardless of the placement of the grid relative to the sensitive area array the opaque areas always cover the same amount of area of the sensitive area, may modify this invention in numerous ways to achieve this result. These modifications are to be construed as being encompassed within the scope of the present invention as set forth in the appended claims.

We claim:

1. A scattered radiation shielding grid comprising a radiation absorbing material representing a pattern corresponding to a combined motif of a plurality of tiled prototiles, each prototile comprising a width $W(p)$, a length and a motif solely within the prototile, wherein the prototile width $W(p)=W/(I\pm0.05I)$ and $W(p)\neq W+D$, where W is a radiation sensitive area width of a radiation sensor of a radiation detection panel comprising a plurality of equal size radiation sensors separated by interstitial spaces having a width D, over which said grid is positioned, and I is an integer.

2. The scattered radiation grid according to claim 1 wherein $W(p)=W/I$.

3. A scattered radiation shielding grid comprising a radiation absorbing material, and a radiation detection panel over which said grid is positioned comprising a plurality of equal size radiation sensors having a radiation sensitive area width W, separated by radiation insensitive interstitial spaces having a width D, and wherein said grid absorbing material forms a pattern representing a combined motif of a tiled plurality of substantially identical prototiles, each prototile comprising:

(a) a width $W(p)=W/I$, wherein I is an integer;

(b) a length; and (c) a motif contained solely within the prototile.

4. The scattered radiation grid and detection panel according to claim 3 further comprising a gain correction circuit associated with said detection panel and wherein $W(p)=W/(I\pm0.05I)$ and $W(p)\neq W+D$.

5. The scattered radiation grid and detection panel according to claim 4 further comprising a radiation source and said grid is positioned between said panel and said radiation source at a fixed, known distance from said panel, wherein said prototile width $W(p)$ is a projected prototile width on said panel.

6. A method for designing a pattern for absorption material for a scattered radiation shielding grid for a radiation detection panel comprising an array of a plurality of sensors each having a radiation sensitive area having a width W and a length, the sensors arrayed so that each radiation sensitive area is separated by each adjacent radiation sensitive area by an interstitial space having a width D, the method comprising:

a) determining a sensor width corresponding to the width of the radiation sensitive area of the sensor b) creating a prototile having a width $W(p)=W/I$ wherein I is an integer;

c) producing within said prototile a motif and d) tiling a plurality of said prototiles to produce the pattern, said pattern consisting of the combined motif of the tiled prototiles.

7. A method for manufacturing a scattered radiation shielding grid comprising a pattern of radiation absorbing material for a radiation detection panel comprising an array of a plurality of sensors each having a radiation sensitive area having a width W and a length, the sensors arrayed so that each radiation sensitive area is separated by each adjacent radiation sensitive area by an interstitial space having a width D, the method comprising:

a) determining a sensor width W corresponding to the width of the radiation sensitive area of the sensor b) creating a prototile having a width $W(p)=W/(I\pm0.05I)$, $W(p)\neq W+D$ and wherein I is an integer;

c) producing within said prototile a motif;

d) tiling a plurality of said prototiles to produce a pattern consisting of the combined motif of the tiled prototiles;

e) forming said radiation absorbing material in said grid in the shape of said combined motif.

8. The method according to claim 7 wherein in step (b) the prototile width: W(p)=W/I.

9. A method for generating a radiogram with an exposure system comprising radiation source, and a radiation detection panel, wherein said radiation detection panel comprises an array of a plurality of sensors each having a radiation sensitive area having a width W and a length, the sensors arrayed so that each radiation sensitive area is separated by each adjacent radiation sensitive area by an interstitial space having a width D, the method comprising:

positioning between said radiation source and said panel a grid comprising a radiation absorbing material formed in a pattern representing a combined motif of a plurality of substantially identical tiled prototiles, each prototile comprising a width W(p), a length and said motif, said motif contained solely within the prototile, wherein the prototile width W(p)=W/I where I is an integer.

10. The method of producing a radiogram according to claim 9 wherein said system further comprises a gain correction circuit, said prototile width W(p)=W/(I±0.05I), W(p)≠W+D and wherein after positioning the grid between said source and said panel there is performed a calibration step comprising exposing the panel to radiation through said grid and adjusting said gain correction circuit to produce a uniform output from all sensors in said panel.

* * * * *